US011837076B2

(12) United States Patent
Stringer

(10) Patent No.: US 11,837,076 B2
(45) Date of Patent: Dec. 5, 2023

(54) HANDHELD SIGN WITH WARNING SYSTEM

(71) Applicant: Theory Stringer, Deltona, FL (US)

(72) Inventor: Theory Stringer, Deltona, FL (US)

( * ) Notice: Subject to any disclaimer, the term of this patent is extended or adjusted under 35 U.S.C. 154(b) by 0 days.

(21) Appl. No.: 17/803,173

(22) Filed: Aug. 27, 2021

(65) Prior Publication Data

US 2023/0063083 A1 Mar. 2, 2023

Related U.S. Application Data

(60) Provisional application No. 63/070,810, filed on Aug. 26, 2020.

(51) Int. Cl.
*G08B 5/00* (2006.01)

(52) U.S. Cl.
CPC ..... *G08B 5/006* (2013.01)

(58) Field of Classification Search
CPC ..... G08B 5/006
See application file for complete search history.

(56) References Cited

FOREIGN PATENT DOCUMENTS

KR 200409301 Y1 * 2/2006
WO WO-2007018836 A2 * 2/2007 ..... G08B 5/006

* cited by examiner

*Primary Examiner* — Curtis A Kuntz
*Assistant Examiner* — James E Munion

(57) ABSTRACT

A handheld warning sign including front and back with at least one side having a predetermined color and warning information printed directly on the sign. A handle member is fastened to the bottom of the sign enabling it to be handheld. A longer pole extension structure can be attached to the sign handle member enabling it to extend to the ground allowing the sign to be used as a handheld sign. An electronic sound device is positioned within the handle member of the sign and connected to a battery and a off and on power switch. When the sound device is activated it produces a warning sound like a whistle, siren or other warning sounds to attract the attention of motorists or pedestrians so that they can safely follow the directions of the safety personnel.

13 Claims, 7 Drawing Sheets

HANDHELD SIGN WITH WARNING SYSTEM

RELATED APPLICATIONS

The present application is related to U.S. patent No. 63/070,810, issued Aug. 26, 2020, for HANDHELD SIGN DEVICE WITH WARNING SYSTEM, by Theory (Theotis) Stringer, included by reference herein.

FIELD OF THE INVENTION

The present invention relates, to hand-held signs and, more particularly, this invention relates to handheld signs having a battery powered electronic sound device that when activated emits an electronic warning sound such as a whistle, siren, or other electronic sounds to aid in controlling traffic and warning motorist and pedestrians near constructions sites, intersections, schools zones and other area where pedestrians cross roadways.

BACKGROUND OF THE INVENTION

Prior to the conception and development of the present invention, safety personnel such as traffic police, school crossing guards, and construction workers, have used handheld signs to direct pedestrian traffic and to help children safely cross streets and intersections. Sometimes motorist are distracted on roadways near intersections, school zones, construction sites, and places where children and pedestrians cross roadways endangering the lives of other motorist and especially pedestrians.

Traffic officers, flagmen, and school crossing guards, often use whistles along with handheld signs to aid in controlling traffic and helping children and other pedestrians safely cross at dangerous intersections and roads around schools by blowing whistle warning sounds to alert motorist to "STOP,' when pedestrians are about to cross the road. However because of a concern that blowing air through a whistle around others increases the chances of spreading germs and other infectious bacteria into the air many agencies require masks to be worn by safety personnel. Mask are required at some schools. So it is not practical to use traditional whistles around pedestrians because of this requirement.

There have been some improvements made on handheld signs by adding battery powered lights to the signs to better alert and warn drivers and pedestrians at intersections, in road constructions areas, and school crossings for safer traffic control.

Also because of the mask requirements, some state and county agencies have implemented the use of handheld electronic whistles instead of traditional whistles for safety personnel.

A short coming of using a handheld electronic whistle is that the safety personnel's directing hand is no longer always free when performing their duties.

Although the battery powered light sign is a good improvement over the standard handheld sign for warning motorist and pedestrians, the visual effects of this sign is not as effective as the piercing sound of a whistle or other electronic sounds in arresting motorist and pedestrians attention.

It is therefore an object of the invention to provide a handheld sign that can emit electronic generated sounds such as a whistle, horn, siren, or other electronic sounds to warn and assist pedestrians in safely crossing roads and intersections.

It is another object of the invention to provide a handheld sign that can emit electronic generated sounds for the use of traffic control.

It is another object of the invention to provide a handheld sign that can emit electronic generated sounds without the operator spreading germs into the air by blowing a whistle.

It is another object of the invention to provide a handheld sign that can emit electronic generated sounds that can be held in one hand by the operator enabling their other hand to always be free to direct traffic and pedestrians.

It is another object of the invention to provide a handheld sign to better assist safety personnel in traffic control.

SUMMARY OF THE INVENTION

In accordance with the present invention, there is provided a light-weight handheld sign that displays regulatory information on one or both sides of the sign expanse. A handle member securely connected to the bottom of the sign enabling it to be held with one hand. A pole extension structure can be attached to the sign's handle member enabling the base to stand on the ground and held by the hand as a pole sign. An electronic sound device powered by at least one rechargeable, or disposable battery and positioned inside the sign's handle member or pole structure. An "on and off" power switch on the handle member controls the power flow from the battery to the electronic sound device. When pressed, the sound device button on the handle member enables the electronic sound device to emit a warning sound such as a whistle, siren or other electronic sounds to warn motorists or pedestrians.

BRIEF DESCRIPTION OF THE DRAWINGS

A complete understanding of the present invention may be obtained by reference to the accompanying drawings, when considered in conjunction with the subsequent, detailed description, in which.

DESCRIPTION OF THE PREFERRED EMBODIMENT

Figure 1:
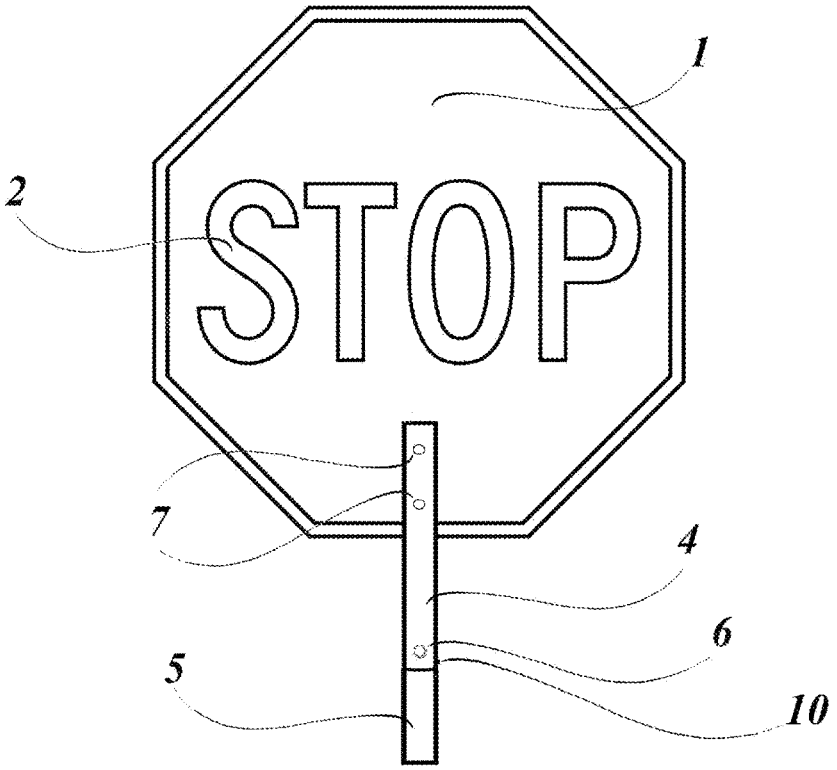
FIG. 1 is a front view of a stop/slow handheld sign device with warning system displaying the stop side of the sign according to a presently preferred embodiment of the present invention.

FIG. 1 is a front view of a handheld sign 1 showing the regulatory information stop 2 on the front expanse of Sign 1. Sign 1 is connected to the handle member 4 with fasteners 7. A handle grip 5 is secured to the handle member 4 to comfortably hold sign 1 with hand. An electronic sound device 9 having at least one battery 12 is located inside handle member 4. Power switch 10 is connected to the electronic sound device 9 and when power switch 10 is in the ON position it sends power from the battery 12 to the electronic sound device 9. Sound device button 6 is mounted on the handle member 4. When the sound device Button 6 is pressed, it emits a warning sound including a whistle or other electronic sounds.

Figure 2:
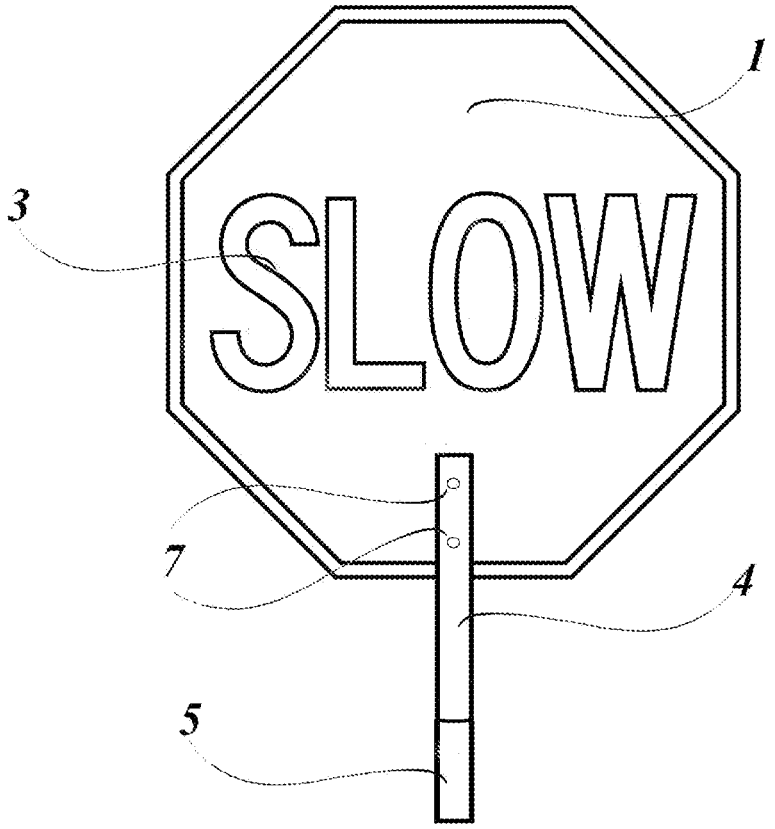
FIG. 2 is a rear view of a stop/slow handheld sign according to a presently preferred embodiment of the present invention.

FIG. 2 is a rear view of a handheld sign 1 showing the Regulatory information Slow 3 on the rear expanse of Sign 1. Sign 1 is connected to the handle member 4 with fasteners 7. A handle grip 5 is secured to the handle member 4 to comfortably hold sign 1 with hand. An electronic sound device 9 having at least one battery 12 is located inside handle member 4. A sound device button 6 is mounted on the handle member 4 to activate the battery 12 powered electronic sound device 9. When power switch 10 is in the ON position and sound device button 6 is pressed, the electronic sound device 9 emits a warning sound including a whistle or other electronic sounds.

Figure 3:
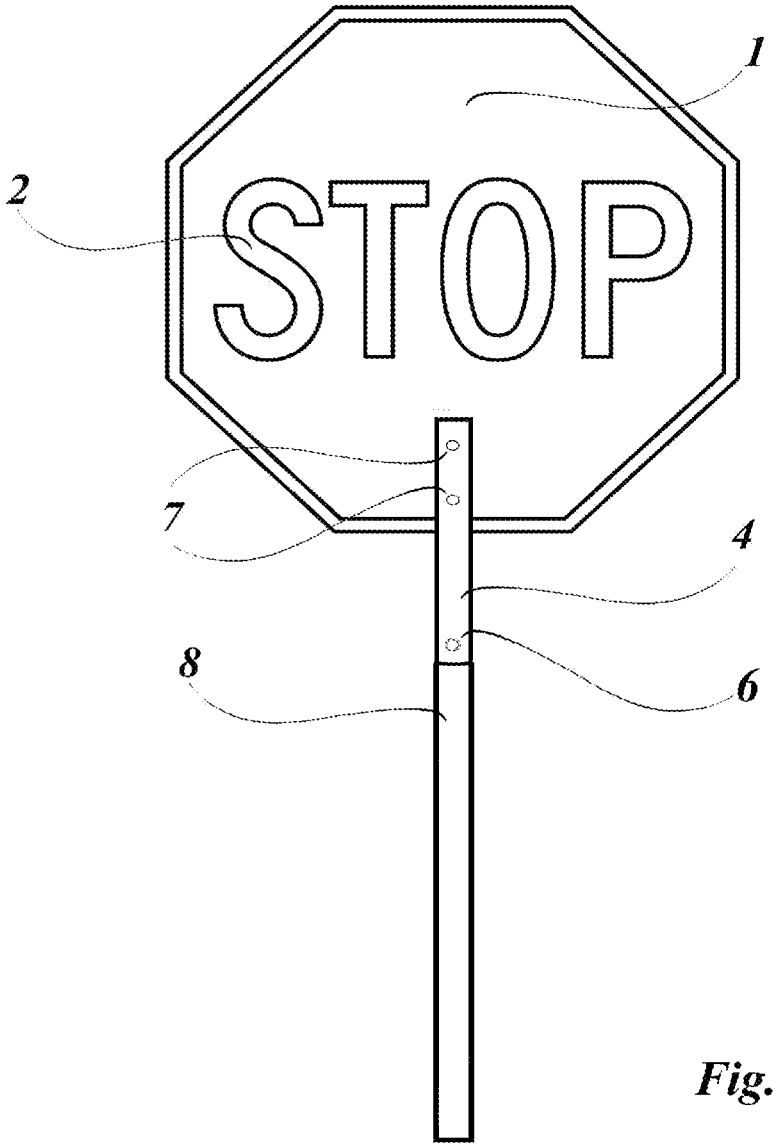
FIG. 3 is a front view of a sign with pole extension according to a presently preferred embodiment of the present invention.

FIG. 3 is a front view of a sign 1 having the regulatory stop 2 on the front expanse of the sign 1. Sign 1 having the regulatory instruction stop 2 on the front expanse of the sign. Sign 1 is connected to the handle member 4 with fasteners 7. A Pole Extension 8 is connected to the handle member 4 with fasteners 7 allowing sign 1 to stand on the ground and held with one hand. A battery 12 powered electronic sound device 9 is located inside handle member 4. A sound device button 6 is located on the handle member 4 and is connected to the battery 12 powered electronic sound device 9. When power switch 10 is in the ON position and sound device button 6 is pressed, the electronic sound device 9 emits a warning sound including a whistle or other electronic sounds.

Figure 4:
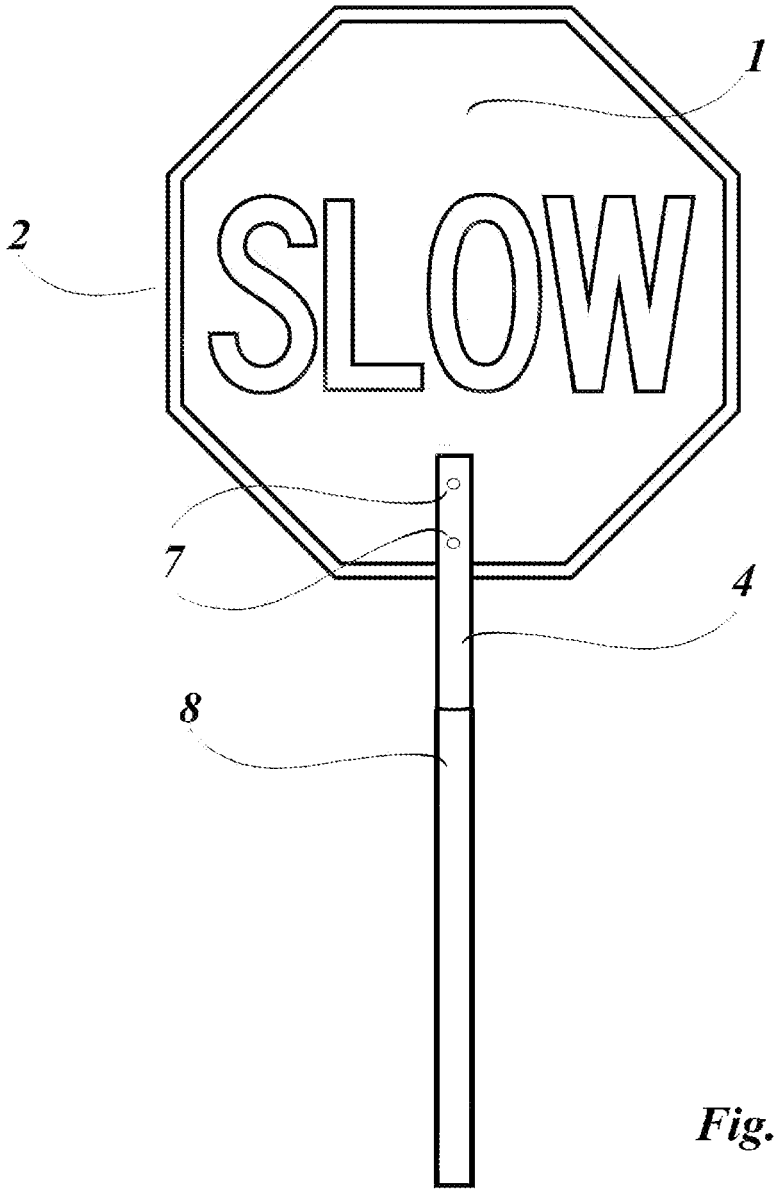
FIG. 4 is a rear view of a sign with pole extension.

FIG. 4 is a rear view of a sign 1 having the regulatory instruction—Slow 3 on the rear expanse of the sign 1. Handle member 4 is fastened to the sign 1 with fasteners 7. A Pole Extension 8 is connected to the handle member 4 extending the handle allowing the sign 1 assembly to stand on the ground and held with one hand. An electronic sound device 9 connected to a rechargeable battery 12 or other power source inside the handle member 4 is activated by pressing the sound device button 6 located on handle member 4 of sign 1.

Figure 5:
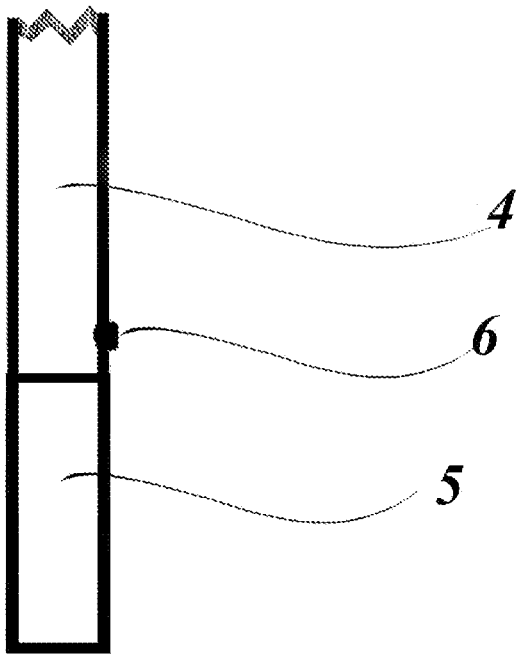
FIG. 5 is a right view of a handheld sip handle member.

FIG. 5 is a right side view of the handheld sign 1 handle member 4 with handle grip 5 showing the sound device button 6 located on handle member 4.

Figure 6:
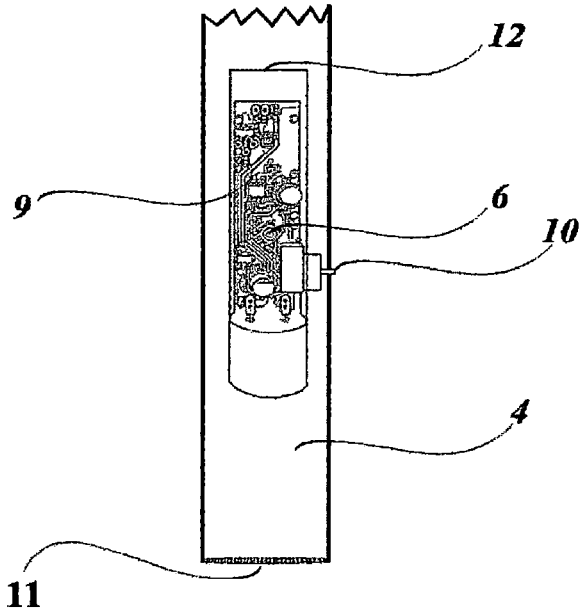
FIG. 6 is a front exploded view of a handheld sign handle member with electronic sound device; and the sound vent at the bottom of handle member.

FIG. 6 is a front exploded view of the handheld sign 1 handle member 4 showing a battery 12, electronic sound device 9 connected to sound device button 6 on handle member 4. The power switch 10 is connected to the electronic sound device 9 and when the power switch 10 is in the ON position it sends power from the battery 12 to the electronic sound device 9. And when sound device button 6 is pressed the electronic sound device 9 emits a warning sound including a whistle, siren, or other warning sounds that comes out of the bottom end of handle member 4 through the sound vent 11.

Figure 7:
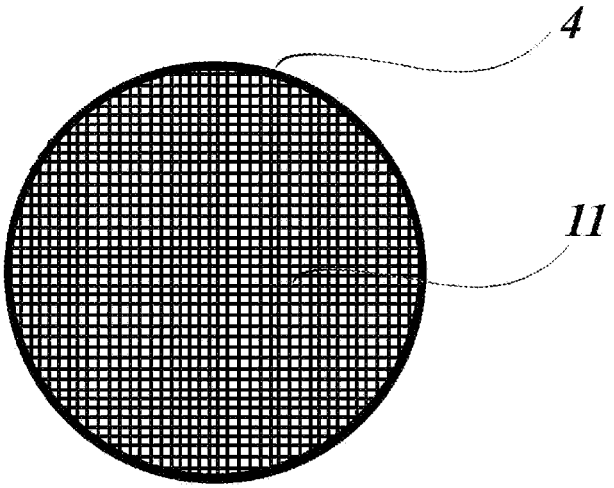
FIG. 7 is a bottom perspective view of a handheld sign handle member showing the sound vent.

FIG. 7 is a bottom perspective of the handheld Sign 1 showing the sound vent 11 at the bottom of the handle member 4 that allows electronic warning sounds including a whistle, siren, or other electronics sounds to pass down through the handle member 4 and out through the sound vent 11 when power switch 10 is in the ON position and the sound device button 6 is pressed.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A handheld sign device with warning system, comprising:

means for aiding safety personnel in controlling motorist traffic in construction areas, intersections, school zones and other areas where pedestrians cross roadways;

means for securing handle member to sign, rigidly connected so safety personnel can securely hold sign when controlling motorist traffic in construction areas, intersections, schools zones and other areas where pedestrians cross roadways;

means for providing regulatory information to vehicle traffic and pedestrians to stop or to slowly proceed when instructed by safety personnel;

means for providing regulatory information printed directly on the front, back, or both sides of a handheld sign to instruct vehicle traffic and pedestrians to stop or to slowly proceed when instructed by safety personnel;

means for attracting the attention of automobile drivers and pedestrians and aiding in directing road and pedestrian traffic by emitting an electronic warning sound including a whistle, siren, and other warning sounds when the electronic sound device is engaged;

means for hand support for a hand held sign including a handle member providing a structure for the electronic sound device, rigidly connected by a fastening system for securing handle member to sign;

means for extending the handle member so allowing it to stand on the ground and held as a pole sign, rigidly connected to handle member for hand support;

means for providing a regulatory information sign with a power switch located on the handle member, rigidly connected to a electronic sound device inside the handle member, and rigidly connected to at least one battery, When the power switch is on, and the power button is pressed it activates the electronic sound device and it emits an electronic warning sound including a whistle, siren, and other warning sounds attracting the attention of automobile drivers and pedestrians and aiding in directing road and pedestrian traffic;

means for providing a regulatory information sign rigidly connected to a handle member with a electronic sound device, when the electronic sound device is activated it allows a warning sound to pass from the electronic sound device, and down the inside of the handle member and out through the mesh screen sound vent at the bottom of handle member attracting the attention of automobile drivers and pedestrians and aiding in directing road and pedestrian traffic by emitting an electronic warning sound including a whistle, siren, and other warning sounds when the electronic sound device is engaged;

means for providing a regulatory information sign with a electronic switch for turning an electronic sound device on and off, rigidly connected to the handle member that provides hand support for holding the sign and providing a structure for the electronic sound device;

means for giving power to an electronic sound device including at least one battery, rigidly connected to a power switch, and sound device button for turning the electronic sound device on and off.

2. A handheld sign device with warning system in accordance with claim 1 comprising; a handheld sign for aiding safety personnel in controlling motorist traffic in construction areas, intersections, schools zones and other areas where pedestrians cross roadways.

3. A handheld sign device with warning system in accordance with claim 1 comprising; fasteners and other connecting materials for securing handle member to sign.

4. A handheld sign device with warning system in accordance with claim 1 comprising; a sign for providing regulatory information printed directly on the front or back of a handheld sign to instruct vehicle traffic and pedestrians to take the appropriate action when instructed by safety personnel.

5. A handheld sign device with warning system in accordance with claim 1 comprising; a sign for providing regulatory information to vehicle traffic and pedestrians to slowly proceed, to stop, or to follow other directions when instructed by safety personnel.

6. A handheld sign device with warning system in accordance with claim 1 comprising; a sign with an electronic sound device rigidly connected inside of the handle member for attracting the attention of automobile drivers and pedestrians and aiding in directing road and pedestrian traffic by emitting an electronic warning sound including a whistle, siren, and other warning sounds when the electronic sound device is engaged.

7. A handheld sign device with warning system in accordance with claim 1 comprising; a sign with handle grip for hand support for the sign and providing a structure for the electronic sound device.

8. A handheld sign device with warning system in accordance with claim 1 comprising; a sign with extending handle member allowing sign to stand on the ground and held as a pole sign.

9. A handheld sign device with warning system in accordance with claim 1 comprising; a sound device button to activate an electronic sound device when pressed and when power switch is on.

10. A handheld sign device with warning system in accordance with claim 1 comprising; a handheld sign with handle member with an electronic warning device positioned inside, and when activated emits an electronic warning sound that passes down through the bottom of the handle member and comes out through the sound vent located at the bottom of the handle member.

11. A handheld sign device with warning system in accordance with claim 1 comprising; a power switch connected to electronic sound device and power button for turning the electronic sound device on and off.

12. A handheld sign device with warning system in accordance with claim 1 comprising; at least one battery for giving power to the electronic sound device.

13. A handheld sign device with warning system in accordance with claim 1 comprising;

a sound vent with a mesh screen located at the bottom of the handle member that allows electronic warning sounds including whistles, sirens, and other electronic sounds traveling downward from an electronic sound device inside the handle member to pass out the handle member bottom when the electronic sound device is activated attracting the attention of automobile drivers and pedestrians, and aiding in directing road and pedestrian traffic.

* * * * *